US006824480B2

(12) United States Patent
John et al.

(10) Patent No.: US 6,824,480 B2
(45) Date of Patent: Nov. 30, 2004

(54) METHOD AND APPARATUS FOR LOCATION OF OBJECTS, AND APPLICATION TO REAL TIME DISPLAY OF THE POSITION OF PLAYERS, EQUIPMENT AND OFFICIALS DURING A SPORTING EVENT

(76) Inventors: Eugene Britto John, 7112 Ridge Oak Rd., Austin, TX (US) 78749; Heinrich Daniel Foltz, Route 9, Box 771D, Edinburg, TX (US) 78539

( * ) Notice: Subject to any disclaimer, the term of this patent is extended or adjusted under 35 U.S.C. 154(b) by 269 days.

(21) Appl. No.: 10/034,786

(22) Filed: Dec. 27, 2001

(65) Prior Publication Data

US 2003/0125138 A1 Jul. 3, 2003

(51) Int. Cl.[7] ..... A63B 67/00
(52) U.S. Cl. ..... 473/415; 463/39
(58) Field of Search ..... 473/199, 353, 473/415, 467, 570; 340/988; 463/39–40

(56) References Cited

U.S. PATENT DOCUMENTS 6,111,536 A * 8/2000 Richards et al. ..... 342/125
6,316,934 B1 * 11/2001 Amorai-Moriya et al. ..... 324/207.17
6,347,229 B1 * 2/2002 Zelmanovich et al. ... 455/456.1
2003/0054905 A1 * 3/2003 King ..... 473/467

* cited by examiner

*Primary Examiner*—Kim Nguyen

(57) ABSTRACT

This application describes a method and apparatus for precisely locating moving or stationary objects, with specific application to the real time display of the position of balls and/or players in sporting events and/or monitoring of airplanes in runways, prisoners in prison, children in childcare, and basically subjects in any area with predetermined boundaries.

11 Claims, 2 Drawing Sheets

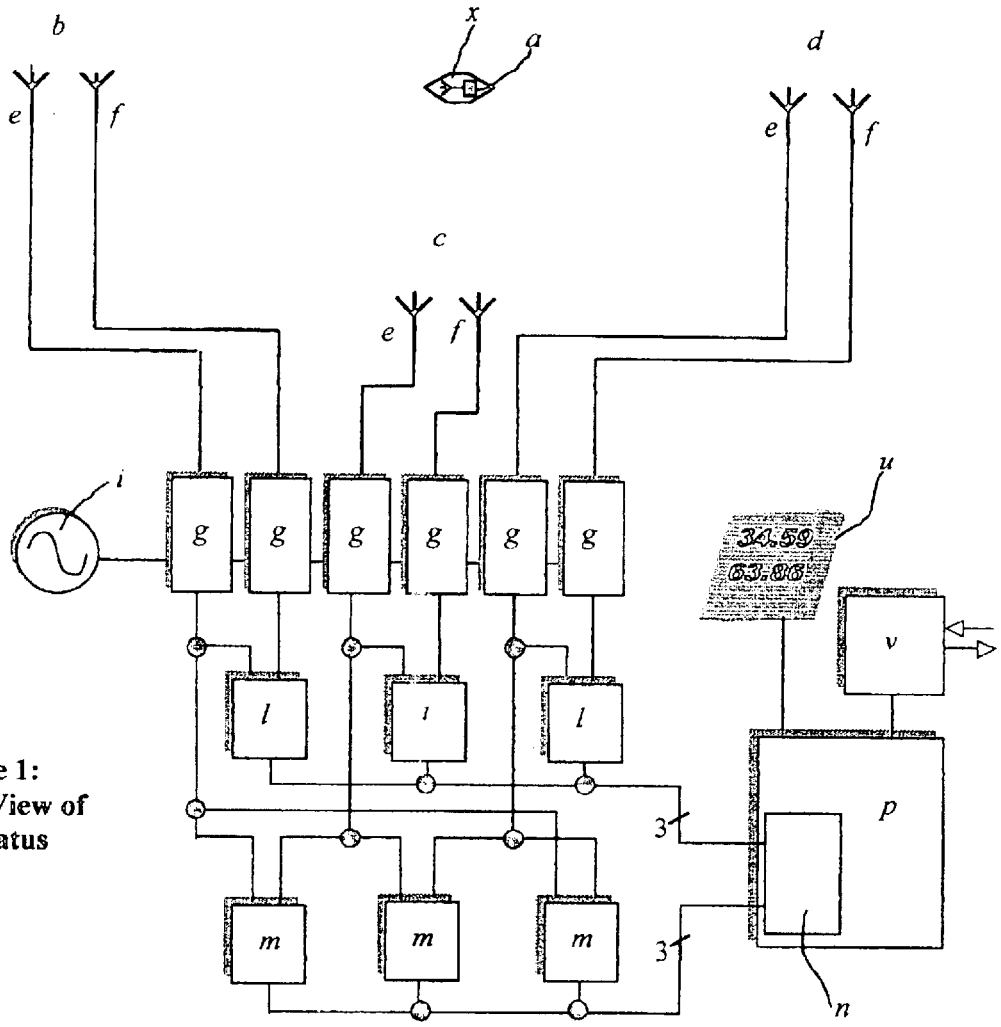
Figure 1: General View of Apparatus

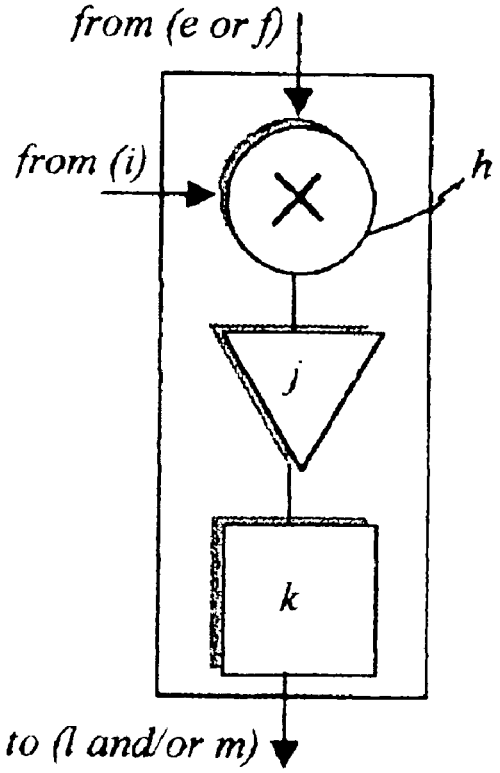
Figure 2: Details of Receiver (g)
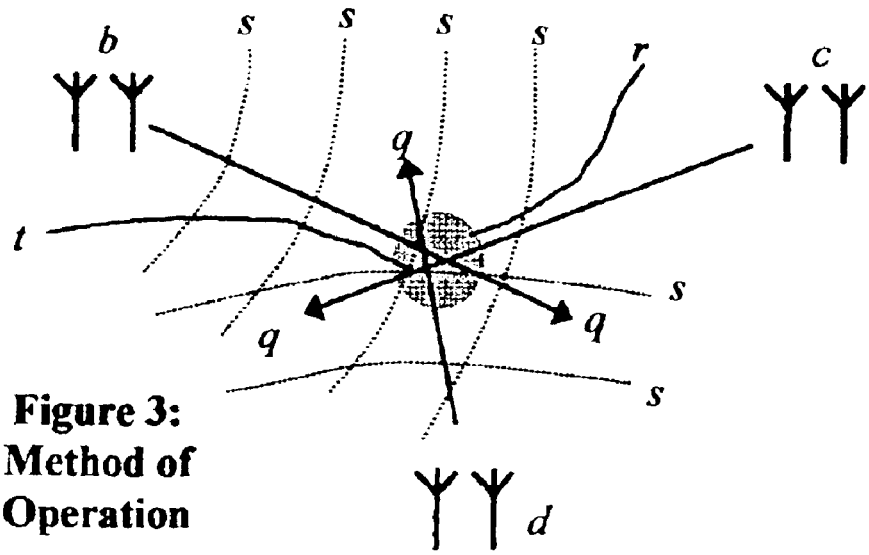
Figure 3: Method of Operation

METHOD AND APPARATUS FOR LOCATION OF OBJECTS, AND APPLICATION TO REAL TIME DISPLAY OF THE POSITION OF PLAYERS, EQUIPMENT AND OFFICIALS DURING A SPORTING EVENT

CROSS REFERENCE RELATED APPLICATIONS

Not Applicable

STATEMENT REGARDING FEDERALLY SPONSORED RESEARCH

Not Applicable

REFERENCE TO SEQUENCE LISTING

Not Applicable

BACKGROUND OF THE INVENTION

The present invention is directed to a system for locating moving or stationary objects. In many types of sports (for example, football, golf, or baseball) the precise position of the ball or other piece is crucial to the play of the game but may be difficult for the players and/or officials to locate quickly and precisely, or, in the case of spectator sports, difficult for the spectators to ascertain conveniently. The invention describes a system which allows a precise, three-dimensional location of a moving or stationary object within an area of interest.

The determination can be updated repeatedly and rapidly to create a real time display of the objects' location as it changes with time. As an example, the system could be used to provide a display of a football's location on a playing field even when the ball is obstructed or hidden. Such a system could be useful to enhance spectators' interest in and understanding of the game, aid the referees in determining when a first down had occurred, or aid in training both players and referees.

The present invention is primarily directed to, the pinpoint locating of equipment and paraphernalia utilized in playing, scoring and officiating the game, as well as tracking the players, coaches and officials and the officials' equipment during the sporting event. The tracking of the officials' flags, markers, etc. will enhance the officiating by determining the exact location of the game ball, with respect to the out of bound lines, first down markers, goal line, field goal uprights, etc.

Furthermore, players and coaches are contemplated as being fitted with a sensor to determine their location on the field, their rate of movement, how high they are jumping etc. This information can be processed and provided to the viewers to enhance viewing pleasure on and off the playing site. For instance, a game announcer could be reviewing the real time data and provide the viewer with the information that the receiver is running at 27 feet per second while the trailing defensive back is only moving at 25.5 feet per second.

Another aspect of the present invention is to place sensor in the game ball to locate the ball. For instance in football, sensors would be placed in the nose portions of the ball and by using radio triangulation the precise three dimensional pinpoint location of the ball can be determined. This is especially important when the ball is being marked once a tackle is made. Since officials views are often blocked or obscured during a play, the precise location of the ball is difficult to determine. With the sensors in place, once the official blows the whistle the location of the ball can be marked, or frozen at that place and accurately marked for the next down.

The sporting event may be any sporting event, including but not limited to, football, baseball, golf, tennis, field hockey, ice hockey, soccer, basketball, or for that matter any of the events contested at the Olympics.

A wide variety of radiolocation techniques are available to determine the position of moving objects. Some of these techniques involve attaching or embedding a global positioning system (GPS) receiver or similar device within the object to be tracked, and then transmitting a message containing the objects location. Due to the complexity, size and power consumption of the receiver these techniques necessarily add substantial weight, which will often be unacceptable and objectionable in the case of a ball used in sports.

Other techniques attach a simpler transmitter to the object to be tracked, and then use direction finding receivers to locate the object. There are several variations on this technique. Some include triangulation using two or more direction finding (nulling type) antennas, either mechanically or electronically steered. Such systems require either mechnical motion of the direction finding antennas, which decreases reliability and may be distracting for participants and spectators, or electronic phasing, which is more reliable but requires complex electronic circuitry. In addition, a high level of accuracy is most useful in most sports applications. For example, in the case of a football, it would be desirable to be able to determine the ball's position to within one inch (2.5 cm) in an area over three hundred feet (one hundred meters) long. This requires angular direction finding with an accuracy of two arc minutes or better, a very difficult task.

Other systems operate by using a pulsed transmitter, and then measuring the time delay for the signal to arrive at three or more receiving locations. These systems require very precision timing circuitry to locate objects with the accuracy that would be needed to make a system most useful in sports applications. For the example above, in which a football is to be located to within one inch (2.5 centimeters), the time-of-arrival circuitry would need to be accurate to 0.05 nanoseconds or less.

The apparatus described here does not require any form of receiver on or in the object to be tracked; do not utilize any steered antennas; and does not need precision timing circuitry. Three dimensional location can be obtained using only a simple, transmitter on the object to be tracked along with two (or more) pairs of antennas with receivers distributed around the perimeter of the area within which the object is to be tracked. The system measures the phase shift in the arrived signal within each closely spaced pair of antennas to obtain three (or more) direction vectors that give a coarse position of the object. The fine position of the object is then resolved by measuring the phase shift in the arrived signal between widely spaced pairs of elements. At very high frequencies (VHF) a phase measurement accuracy of 1–2 degrees is sufficient to give the required accuracy in the determination of the object's location.

SUMMARY OF THE INVENTION

As explained in the previous section, currently, in football games, viewer enjoyment of the game as well as the officiating is affected by the inability to know the precise location of the ball because the ball is often hidden by the players in the field. Similarly, in golf, the player chooses the club based on an approximate estimation of the current position. Precise identification of the ball's location and distance from the cup can help the golf player to devise appropriate strategy and utilize the proper golf club. This information can also be used to graphically display the position of the ball with respect to different holes on the golf course in a large display screen or on a handheld device used by the spectators inside or outside the golf course.

The present invention is capable of displaying the location data in real time such as player location, speed, etc. and the precise location of the game ball. All of this information is capable of being displayed on the stadium screens at the sporting event site and on viewers' screens offsite. The data can is capable of being displayed on the screen as the event takes place and toggled on and off at the viewers discretion. The invention is capable of allowing the viewer to modify location of the data on the screen and to modify and edit the amount and the way in which the data presented.

The sensors placed in the game ball emit radio, magnetic or similar waves, and are located by triangulation. A minimum of three receivers are required to precisely locate the position of the game ball in three dimensions. The speed and direction of the game ball and players can also be determined by present invention. The present invention is capable of tracking multiple sensors and providing data regarding their exact position in the x, y and z directions and their relative position and speed to other players or objects fitted with the sensors.

The present invention is also capable of eliminating or selectively tracking sensors, so that even though all the players on a time are fitted with a sensor, all of them need not be tracked at any one time. Although, the present invention is capable of tracking an unlimited number of sensors it will often be practical to only track a few at a time to reduce screen clutter. Also, since most fans are only interested in the star players, it would be most practical to track them all of the time and to track other players on as needed or desired basis.

With respect to locating or tracking the game ball, it will be tracked at all times. For instance in a baseball game, the present invention would be able to provide the viewer with the speed and the spin of the ball and aid in unifying the strike zone. The present invention could also be employed in the batters' bat and the bat speed could be calculated and the position of the ball when the player swung recorded. Was the player six inches ahead of or behind the ball when it crossed the plate or was the bat six inches above or below the level of the ball could be provided to the viewer. It could also be used as a practice and teaching tool in baseball, golf, or tennis just to name a few.

The sensors of the present invention utilize a high frequency in the megahertz range to enable the better resolution, although lower frequencies can also be employed. A circuit in the sensor uses phase detection which increases resolution at a lower cost than conventional methods.

As previously stated, the present invention utilizes two or more sets of widely spaced antennas, each of which consist of a pair of closely spaced antennas.

A transmitter, which may emit either a continuous wave or modulated signal, is attached or embedded within the object to be tracked. A system of receiving antennas is dispersed around the area in which the object is to be tracked. The antennas are arranged in pairs, and two or more such pairs will be used. In the preferred embodiment, the antennas within each pair are relatively closely spaced (typically one-quarter wavelength, more or less), and three or more such pairs are dispersed around the perimeter of the area of interest; however, other antenna arrangements may also be practicable. Each antenna is connected to a receiver, which amplifies and filters, and in the preferred embodiment downconverts the signal, maintaining phase coherence by deriving the local oscillators for all the receivers from a single source. The relative phase difference in signals from antennas within each pair are used to determine the rough or coarse location of the object. The relative phase difference in signals from widely separated antennas is then used to resolve fine and coarse location.

The location data can be sent to a large display board to enhance officiating or spectator enjoyment, sent to a video overlay unit to make locations more obvious to spectators viewing the event by television or webcast, or retransmitted to hand-held display units to aid event players and officials.

In one application, the object to be located would typically be a ball or other game paraphernalia, or a player, in a sporting event. The system can obviously also be used in many of the conventional applications of radiolocation.

BRIEF DESCRIPTION OF THE DRAWINGS

FIG. 1 is a general view of an embodiment of the present invention, illustrating the antennae, receiver, and data processing units;

FIG. 2 is a detailed block diagram of the receiver, which is a sub module of the embodiment of FIG. 1 of the present invention; and FIG. 3 illustrates a method of operation of the present invention.

DETAILED DESCRIPTION

Referring to FIGS. 1, 2, and 3, the object to be located (x) has attached to it or embedded within it a small, low-powered radio transmitter and antenna (a) emitting radiation. Two or more pairs of antenna elements (in the figure we have shown three, namely, b, c, and d) are dispersed around the perimeter of the area in which the object is to be located, and receive signals from the transmitter. Within each pair of elements, the two elements, designated as primary (e) and secondary (f) are spaced approximately ¼ wavelength apart. The total number of antenna elements is at least four; for improved accuracy six or more elements are used in the preferred embodiment.

Each of the antenna elements is attached through a cable to a receiver assembly (g). Each receiver assembly, detailed in FIG. 2, contains a downconvertor (h) and intermediate frequency amplifier (j) which lower the received signal to a frequency suitable for low-cost phase locking and phase detection. It is possible to omit the downconversion and perform phase locking and detection directly at the transmitter frequency; however, the preferred embodiment employs downconversion to gain the advantages of a superhetrodyne receiver, familiar to skilled practioners of radio design. The local oscillator signal or signals for each of the downconvertors is derived from a signal source (i) in order to maintain phase coherence. In the case of multiple conversion downconvertors, each of the local oscillator frequencies required is derived from a signal source.

The output of the intermediate frequency amplifier (j) is the input to a phase locked loop (k) for each of the receivers, in order to stabilize the amplitude of the signal and reduce the effects of noise.

The outputs of the phase locked loops are connected to phase detectors (l) which find the phase difference between two signals. They are connected in the following sequence:

the two signals (primary and secondary) originating with element pair (b) are connected to one phase detector, the two signals (primary and secondary) originating with element pair (c) are connected to a second phase detector, the two signals (primary and secondary) originating with element pair (d) are connected to a third phase detector. If additional element pairs are present they are connected in a continuation of the above sequence.

The outputs of the primary elements in each of the element pairs are simultaneously connected to another series of phase detectors (m). They are connected in the following sequence: the signal originating from the primary element of element pair (b) is connected along with the signal originating from the primary element of element pair (c) to one phase detector. The signal originating from the primary element of element pair (c) is connected along with the signal originating from the primary element of element pair (d) to a second phase detector. The signal originating from the primary element of element pair (d) is connected along with the signal originating from the primary element of element pair (b) to a third phase detector. If additional element pairs are present they are connected such that all combinations of two signals originating from primary elements are each fed to a phase detector (m).

The outputs from the first set of phase detectors (l) may be in the form of an analog level proportional to phase or a pulse train with duty cycle proportional to phase, depending on the type of phase detector selected. In either case, the outputs are connected to a data acquisition unit (n) and computer (p), and are used to compute a direction of arrival of the radio wave from the transmitter, at each of the element pair locations. The resulting direction vectors (q) (FIG. 3) can be intersected (r) to approximately locate the object of interest (x). An accuracy of one degree will correspond to an accuracy of approximately one degree in the direction vector, and the intersection of a number of such direction vectors will yield an accuracy of approximately two meters in an area 100 meters square, yielding the coarse location of the object.

The outputs from the second set of phase detectors (m) may likewise be in the form of an analog level proportional to phase or a pulse train with duty cycle proportional to phase. The outputs are connected to the same data acquisition unit (n) and computer (p). The phase differences of each pair define a set of loci of points (s) along which the object of interest (x) must lie. The loci are separated by a distance of one wavelength; therefore, if the wavelength is as long as the accuracy of the direction vector intersection (r), there will be no ambiguity about the particular locus containing the object of interest. The particular locus computed from the output of each the phase detectors (m) may be intersected with the loci of the other phase detectors in set (m) to yield a location estimate (t) with greatly increased accuracy over the direction vector intersection. An accuracy of one degree will yield an accuracy of one three-hundred-sixtieth ($1/360^{th}$) of one wavelength in physical position. In the preferred embodiment, the object can be located with less than one inch resolution. Therefore, the first set of phase detectors (l) produce coarse location, and the second set (m) are then used to refine the accuracy within the zone defined by the first set (l). Small variations in phase due to local topography or obstructions such as trees or buildings can be compensated by surveying the site after the system is installed and creating a calibration table.

The above method and apparatus can be used alone as one embodiment of the invention. The data can be stored in the computer (p) to provide a permanent record of the object's motion and/or displayed on the computer screen with appropriate software.

In another embodiment, for usage at spectator sporting events, extra apparatus is added consisting of a large digital display (u) and/or a video overlay interface (v), on which the position information is displayed for the convenience and entertainment of officials, players, and spectators. The digital display is for direct viewing, while the video overlay can provide either numerical or graphical indication for television or webcast viewers.

In another embodiment, for usage by trainers, officials, or participants, which may be operated independently of or simultaneously with the previous embodiment, the position information can be transmitted using standard wireless techniques to a handheld receiver and display unit. Optionally, the handheld receiver and display unit can itself be tracked in the same manner as the ball using the invention to allow relative positions to be determined.

The invention and the location information it provides can clearly be applied in a wide range of other applications in which accurate positioning is required, and many alternative designs for each of the component elements of the system will be apparent to skilled practitioners familiar with radio electronics.

The object may contain a receiver in addition to the transmitter in the above description of the embodiment. If a receiver is also included, it will be possible to control the object (eg: switch the system on or off) and/or communicate with the object.

In an alternate embodiment the number of antenna is increased along with the corresponding equipment to increase the resolution and to provide a more accurate location of the game ball and/or players. As the number of antenna increases the accuracy can be reduced to mere millimeters.

In a still further embodiment of the present invention a laser tracking system can be utilized, wherein the game ball is coated with a material that can be tracked by a laser, thus further eliminating the potential of radio wave interference of the equipment. In a yet further embodiment of the present invention a magnetic field can be generated by the sensor, such as a magnet (passive device), which can be sensed and located, thus increasing the life expectancy of the sensor due to battery life limitations.

The present invention can be used in many applications in and outside of the sporting arena where subjects or objects move within a defined territory, such as an airport or prison environment. The advantages of the invention includes low cost, high accuracy and precise resolution. The foregoing detailed description of the invention has been presented for purposes of illustration and description only. It is not intended to be exhaustive or to limit the invention to the precise form disclosed. Obviously many modifications and variations are possible in light of the above teaching.

What is claimed is:

1. A system for determining coarse and fine locations of an object, consisting of the following elements:

(a) Four or more antennas, arranged in two or more closely spaced pairs dispersed in or around an area to be covered;

(b) Downconvertors or receivers attached to each of the antennas, with local oscillators of the downconvertors in all the receivers derived from a single reference;

(c) Phase locked loops to stabilize and reject noise in the downconverted signals;

(d) Phase detectors to determine phase difference between a received signal in each pair of antennas, providing coarse location through intersection of directions of arrival;

(e) Phase detectors to determine phase difference between a received signal in antennas not in the same pair, providing a set of intersections of loci of constant phase difference;

(f) Resolution of the fine location through selection among the intersections of loci of constant phase difference, based on the coarse location obtained in (d);

(g) A transmitter in the object to be tracked.

2. The system of claim 1, wherein the resulting location data is used to provide a real time display of ball location or player location in sporting events.

3. The system of claim 1, wherein the resulting location data is used to provide a display of ball location, player location, or other game piece location, in sporting events, in order to enhance spectators' enjoyment and to aid trainers, players, and officials either in accurate determination of the ball's location and motion, or generation of game statistics, or both.

4. The system of claim 1, wherein the resulting location data is used for airport surveillance or for monitoring the entry of airplanes to wrong runways.

5. The system of claim 1, wherein the resulting location data is used for childcare facility or prison surveillance.

6. The system of claim 1, wherein the resulting location data is used for accurate football game officiating.

7. The system of claim 1, wherein the resulting location data is used for golf player club selection assistance.

8. The system of claim 1, wherein the resulting location data is used for hockey puck location.

9. The system of claim 1, wherein the resulting location data is used for tennis ball location.

10. The system of claim 1, wherein the resulting location data is used for baseball game playing, officiating and generation of statistics.

11. The system of claim 1, wherein the resulting location data is used for monitoring of subjects in an area with defined boundaries.

* * * * *